US005415209A

United States Patent [19]

Candiracci

[11] Patent Number: 5,415,209

[45] Date of Patent: May 16, 1995

[54] FEEDER DEVICE FOR MACHINES FOR MANUFACTURING ELECTRICALLY WELDED METALLIC NETS

[76] Inventor: Angelo Candiracci, Via Rosciano, 46 - 61032 Fano (Prov. of Pesaro), Italy

[21] Appl. No.: 121,487

[22] Filed: Sep. 16, 1993

[51] Int. Cl.[6] ..... B21F 23/00

[52] U.S. Cl. ..... 140/112

[58] Field of Search ..... 140/7, 112; 83/277

[56] References Cited

U.S. PATENT DOCUMENTS

| | | | |
|---|---|---|---|
| 3,280,855 | 10/1966 | Magers, Jr. | 140/112 |
| 4,372,350 | 2/1983 | Schmidt et al. | 140/112 |
| 4,524,656 | 6/1985 | Del Fabro et al. | 83/277 |
| 5,271,436 | 12/1993 | Pfender et al. | 140/112 |

FOREIGN PATENT DOCUMENTS

| | | | |
|---|---|---|---|
| 2363369 | 6/1975 | Germany . | |
| 3422661 | 12/1985 | Germany | 140/112 |
| 1413143 | 11/1975 | United Kingdom . | |

OTHER PUBLICATIONS

Soviet Inventions Illustrated, week 8434, Oct. 3, 1984, Derwent Publications Ltd, London GB & Su-A-1065066.

Soviet Inventions Illustrated, week 9006, Mar. 21, 1940, Derwent Publications Ltd, London GB & Su-A-1496885.

*Primary Examiner*—Lowell A. Larson

*Attorney, Agent, or Firm*—Guido Modiano; Albert Josif

[57] ABSTRACT

The feeder device for machines for manufacturing electrically welded metallic nets comprises a pulling carriage which is slideably mounted on guiding means which extend in the direction of a welding apparatus, so that it can be moved to a working position having an adjustable distance from the welding apparatus; the carriage is provided with: means for straightening a plurality of longitudinal wires to be fed; means for pulling the longitudinal wires, equipped with means for gripping the wires which can be actuated with a reciprocating motion longitudinally with respect to the carriage; and means for cutting the longitudinal wires. Telescopic tubular means, arranged between the pulling carriage and the welding apparatus and supported by intermediate supporting means, are suitable to act as guide for the longitudinal wires.

20 Claims, 7 Drawing Sheets

FIG. 6
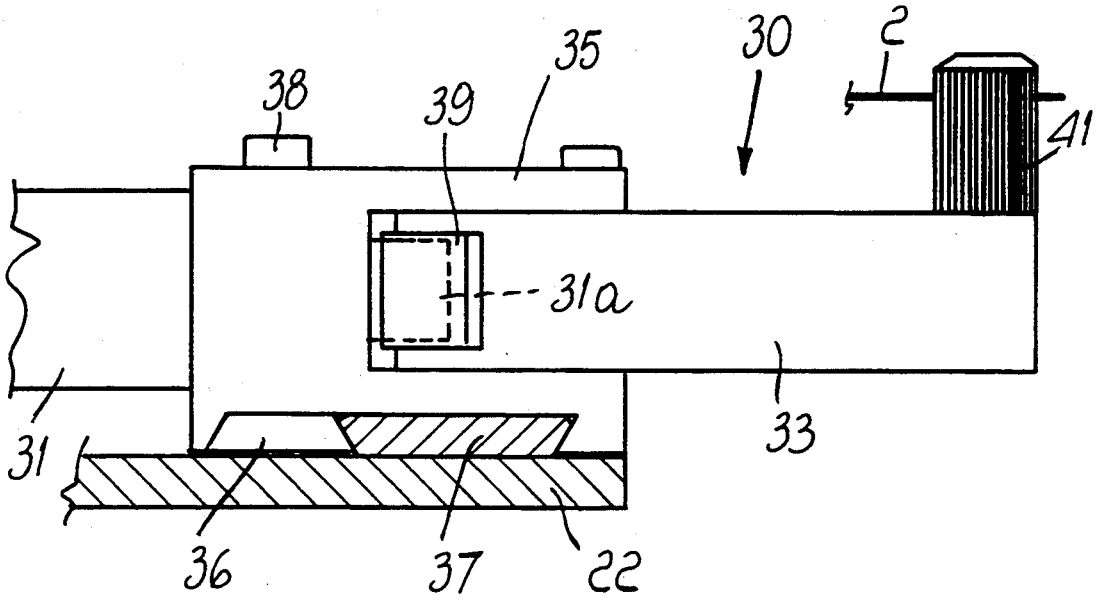
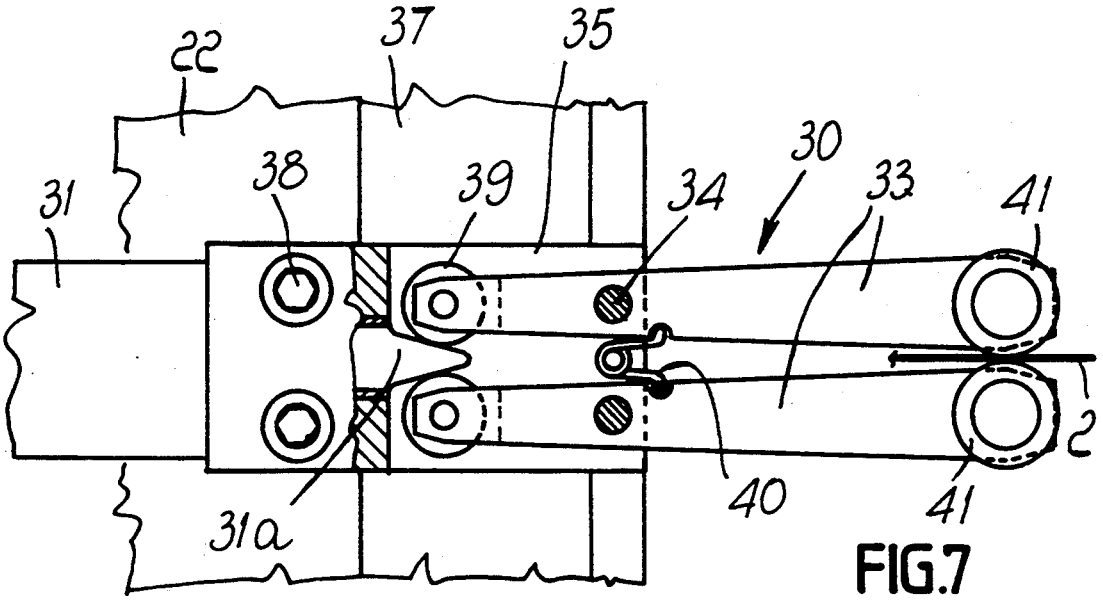
FIG.7

FEEDER DEVICE FOR MACHINES FOR MANUFACTURING ELECTRICALLY WELDED METALLIC NETS

BACKGROUND OF THE INVENTION

The present invention relates to a feeder device for longitudinal wires in machines for manufacturing electrically welded metallic nets.

It is known that in order to produce electrically welded nets, a plurality of longitudinal metallic wires is fed in a parallel arrangement, and appropriate transverse metallic wires are welded to said longitudinal wires at uniform distances. The longitudinal wires to be fed are unwound from respective coils and undergo a straightening operation before welding.

In order to feed the longitudinal wires, apparatuses which supply said wires continuously to the welding machine are in widespread use; the welding machine welds the transverse wires in a uniform succession. After a portion of a metallic net of the required length has been produced, the longitudinal wires are cut.

However, the cutting operation causes the release of the tension induced in the longitudinal wires by the straightening operation. Accordingly, metallic nets thus manufactured have undue distortions.

In order to obviate this drawback, apparatuses with discontinuous operation have been proposed; these apparatuses feed the welding machine with a series of longitudinal wires which have been pre-cut to size and straightened. In this manner the uniformity of the manufactured net is ensured.

However, these apparatuses, by operating discontinuously, have relatively long downtimes, with a consequent decrease in the productivity of the machine. Furthermore, it is evident that these apparatuses lead to poor production flexibility, since in order to manufacture metallic nets of different lengths it is necessary to have in stock corresponding sets of longitudinal wires cut to size and straightened. This forces to hold in stock a large amount of metallic wires or, vice versa, to limit the types of production.

SUMMARY OF THE INVENTION

The aim of the present invention is to solve the above described problem by providing a feeder device which allows to continuously manufacture electrically welded metallic nets of any length, without downtimes in production and ensuring the absence of distortions in the manufactured nets.

Within the scope of this aim, a further object of the present invention is to provide a feeder device which is simple in concept, safely reliable in operation and versatile in use.

This aim and this object are both achieved, according to the invention, by the present feeder device for machines for manufacturing electrically welded metallic nets characterized in that it comprises: a pulling carriage, which is slideably mounted on guiding means which extend towards a welding apparatus, so that it can be moved to a working position which has an adjustable distance from said welding apparatus, and is provided with means for straightening a plurality of longitudinal wires to be fed, with means for pulling said longitudinal wires, said pulling means having elements for gripping said wires which can be actuated with a reciprocating motion longitudinally with respect to said carriage, and with means for cutting said longitudinal wires; telescopic tubular means arranged between said pulling carriage and said welding apparatus suitable to guide said longitudinal wires; and means for the intermediate support of said telescopic tubular elements.

BRIEF DESCRIPTION OF THE DRAWINGS

The details of the invention will become apparent from the detailed description of a preferred embodiment of the feeder device for machines for manufacturing electrically welded metallic nets, illustrated only by way of non-limitative example in the accompanying drawings, wherein:

FIGS. 6 and 7 are respectively an elevation detail view and a plan detail view of said grip means;

DESCRIPTION OF THE PREFERRED EMBODIMENTS

Figure 1A:
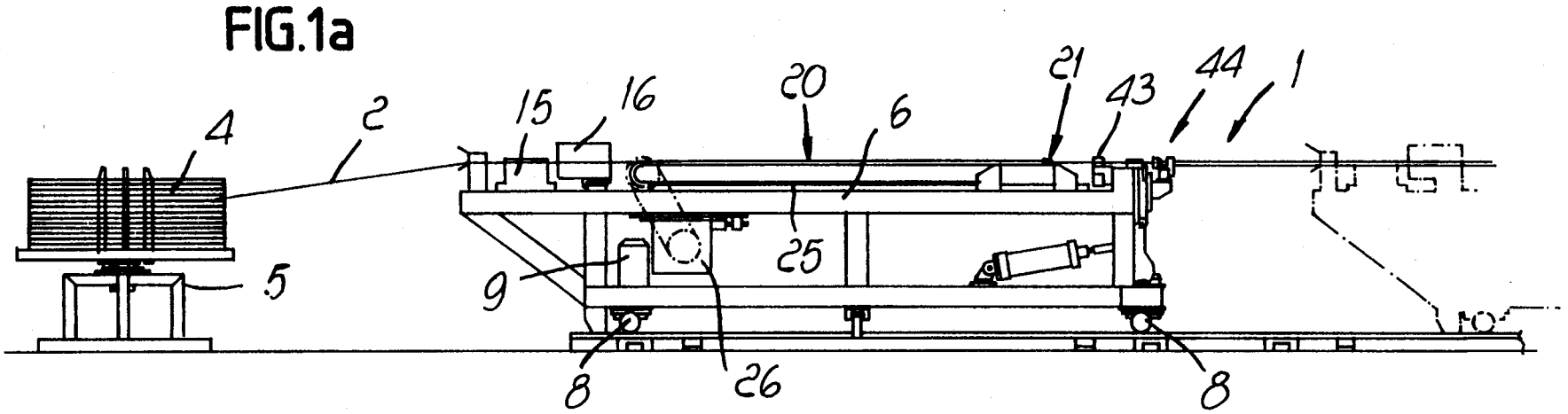
FIGS. 1*a* and 1*b* show, in combination, a schematic longitudinal elevation view of the assembly of the feeder device according to the present invention.
Figure 2A:
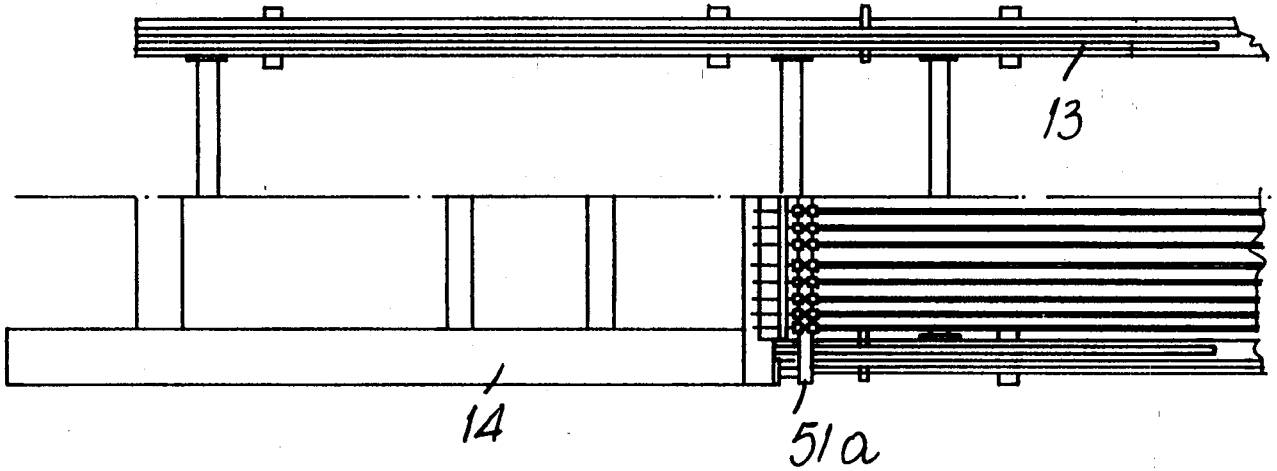
FIGS. 2*a* and 2*b* show a corresponding plan view thereof.

With particular reference to the above figures, the reference numeral 1 generally designates the device for feeding the longitudinal metallic wires 2 to a welding apparatus 3 of a machine for manufacturing electrically welded metallic nets. The longitudinal wires 2 unwind from respective coils 4 which are mounted, with a vertical axis, on related supporting elements 5 and are intermittently motorized, in a known manner, by respective ratchet systems which are actuated by the traction to which said wires are subjected.

The feeder device 1 has a carriage 6 which is suitable to be moved along a pair of rails 7 which extend toward the welding machine 3. The carriage 6 is mounted on wheels 8 and can move by actuation of its own drive unit 9 which, by means of appropriate transmission elements 10, turns a transverse rear shaft 11 which is provided with a pair of pinions 12 at its ends; said pinions 12 mesh with respective racks 13 which are arranged to the side of the rails 7 and extend substantially along half of said rails, starting from the end which is adjacent to the coils 4.

The carriage 6 is substantially constituted by a metallic frame 14 which defines, in an upward region, a horizontal working surface along which the longitudinal wires 2 to be fed advance in a parallel arrangement. At said working surface, the carriage is provided with a plurality of straightening elements 15 and 16, of the type with contrarotating rollers, which are meant to act respectively on a horizontal plane and on a vertical plane. The straighteners 15 and 16 are mounted in an adjustable position along the respective cross-members 17 and 18 of the frame 14. The wires 2 are inserted in a respective pair of straighteners 15 and 16 arranged in series by means of a guiding inlet 19.

Downstream of the straighteners 15 and 16, along the direction of advancement of the wires 2, the carriage 6 is provided with means 20 for pulling said wires 2. Said pulling means 20 are provided with a plurality of grip elements 21 mounted side by side on a beam or cross-member 22 which is slidingly supported, at its opposite ends, by means of respective sliders 23, by a pair of guides 24 which are longitudinally rigidly coupled to the frame 14 of the carriage 6. The cross-member 22 is rigidly coupled, at its opposite ends, to a kinematic transmission constituted by a pair of chain-based elements 25 which extend in a parallel arrangement along the longitudinal sides of the carriage 6. The chains 25 are suitable to be actuated, in alternating directions, by a numeric-control motor 26; the motor 26 turns, by means of a transmission 27, a shaft 28 which is rotatably supported on the carriage 6; related drive pulleys 29 for the chains 25 are keyed to said shaft 28.

The grip elements 21 are substantially Constituted by fluid activated or pneumatic clamps 30 actuated by a respective single-action cylinder 31. The pneumatic cylinders 31 of the clamps 30 are suitable to be fed by means of a flexible tube 32 supported by the frame 14 of the carriage; the tube 32 also carries the suitable electric controls.

As shown in detail in FIGS. 6 and 7, the clamps 30 are constituted by a pair of arms 33 which can rotate on vertical axes about respective pivots 34 on a bracket 35 to which the pneumatic cylinder 31 is horizontally rigidly coupled. The bracket 35 defines, in a downward region, a seat which is complementary to a strip 36 and to a guide 37 which are dovetail-shaped. The guide 37 is fixed on the cross-member 22 and is longitudinal thereto. Screw elements 38 secure the strip 36 against one side of the guide 37, thus locking the bracket 35 in the required position along said guide. Similarly to the straighteners 15 and 16 and to the inlets 19, positions which can be adjusted transversely to the feeder device, according to the required paths and to the number of longitudinal wires being processed, can be also obtained for the grip elements 21.

The stem of the cylinder 31 forms a wedge 31*a* which engages between a pair of rollers 39; said rollers are respectively rotatably supported at one end of the arms 33 so as to secure said arms 33 in contrast with a spring 40. The arms 33 support, at the opposite end, respective knurled rollers 41 protruding vertically upward and between which a related wire 2 is meant to be secured.

The chains 25 are provided with appropriate tension control elements 42.

Downstream of the pulling device 20, at the grip elements 21, there are related vise-like elements 43 suitable to retain the wires 2 so as to prevent their backward movement.

Downstream of the vise-like elements 43, the carriage 6 is provided with means 44 for cutting the fed wires 2. Said cutting means 44 substantially have a blade 45 suitable to be actuated with a reciprocating motion, in abutment with a fixed counterblade 46, by a crank system 47 which is actuated by a jack 48 supported by said carriage 6. The blade 45 is actuated along a vertical plane which is transverse to the advancement direction of the wires 2.

Finally, the carriage 6 is provided with means 49 for locking along the rails 7.

Between the pulling carriage 6 and the welding machine 3 there is a plurality of telescopic tubes 50 suitable to act respectively as guides for the wires 2 to be fed. Said telescopic tubes 50 are constituted by a series of elements 50*a*, 50*b* and 50*c* which progressively increase in diameter and fit inside each other.

The first tubular element 50*a*, which has the smallest diameter, is supported close to one of its ends by a supporting element 51 which is rigidly coupled to the carriage 6 in a front region; at said end, the tube 50*a* is provided with an inlet 52 for inserting the wire 2. At the opposite end, the tube 50*a* is inserted in the second tubular element 50*b*, which is in turn supported, closely to said end, by an intermediate supporting element 53 rigidly coupled to an intermediate carriage 54. The tube 50*b* is inserted in the inlet end of the third tubular element 50*c*, which is supported, proximately to its ends, by a pair of supporting elements 55, 56 which are rigidly coupled to a bench 57 movable on the rails 7 by means of the wheels 58.

The intermediate carriage 54 is substantially constituted by a cross-member 53*a* which is slideably mounted on a pair of outer rails 60 which are arranged outside the rails 7 and are supported at the level of the working surface by means of legs 61.

The bench 57 is normally locked to the rails 7 in working position by virtue of locking means 62. The bench 57 can however be moved in order to perform maintenance, setup operations and the like at the welding machine.

The supports 51, 53, 55 and 56 of the telescopic tubes 50 can be adjusted, transversely to the line along which the wires 2 are fed, along respective cross-members 51*a*, 53*a*, 55*a* and 56*a* provided with grooves 63 along which said supports can be locked by virtue of screw elements 64; said grooves furthermore allow to fix the supports to the pulling carriage 6, to the intermediate carriage 54 and to the bench 57, by virtue of additional screw elements 65.

In the electric welding machine 3, the longitudinal wires 2 encounter respective inlets 66 as an extension of the tubes 50*c*.

The welding machine 3 has, in a known manner, a drop-down magazine 67 for the transverse wires to be welded to the longitudinal wires 2; the wires are welded by means of oppositely arranged welding elements 68. The welding machine 3 is furthermore provided with clamp elements for pulling the longitudinal wires 2, not shown in detail.

The operation of the described feeder device is as follows.

The pulling carriage 6 is initially moved along the rails 7 by means of the motor 9 which actuates the pinions 12, which in turn mesh with the racks 13, until the intended working position is reached.

As the longitudinal wires 2 to be fed to the welding machine 3 leave the coils 4, they are gripped by corresponding grip elements 21 of the pulling device 20 of the carriage 6; the wires 2 are gripped between the knurled rollers 41 of the respective pneumatic clamps 30, which are secured by the insertion of the wedges 31*a* between the related arms 33.

Figure 4:
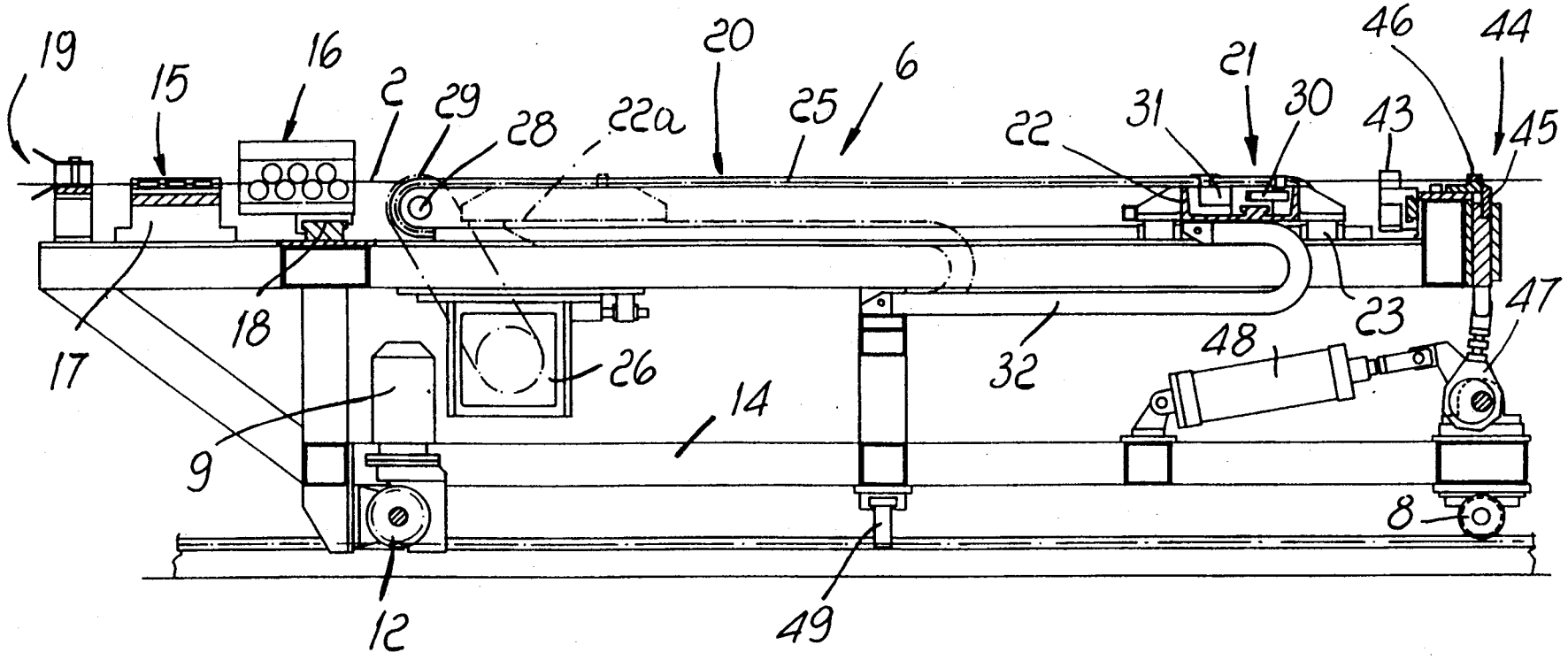
FIGS. 4 and 5 are vertical sectional views, taken respectively longitudinally and transversely, of said pulling carriage.
Figure 5:
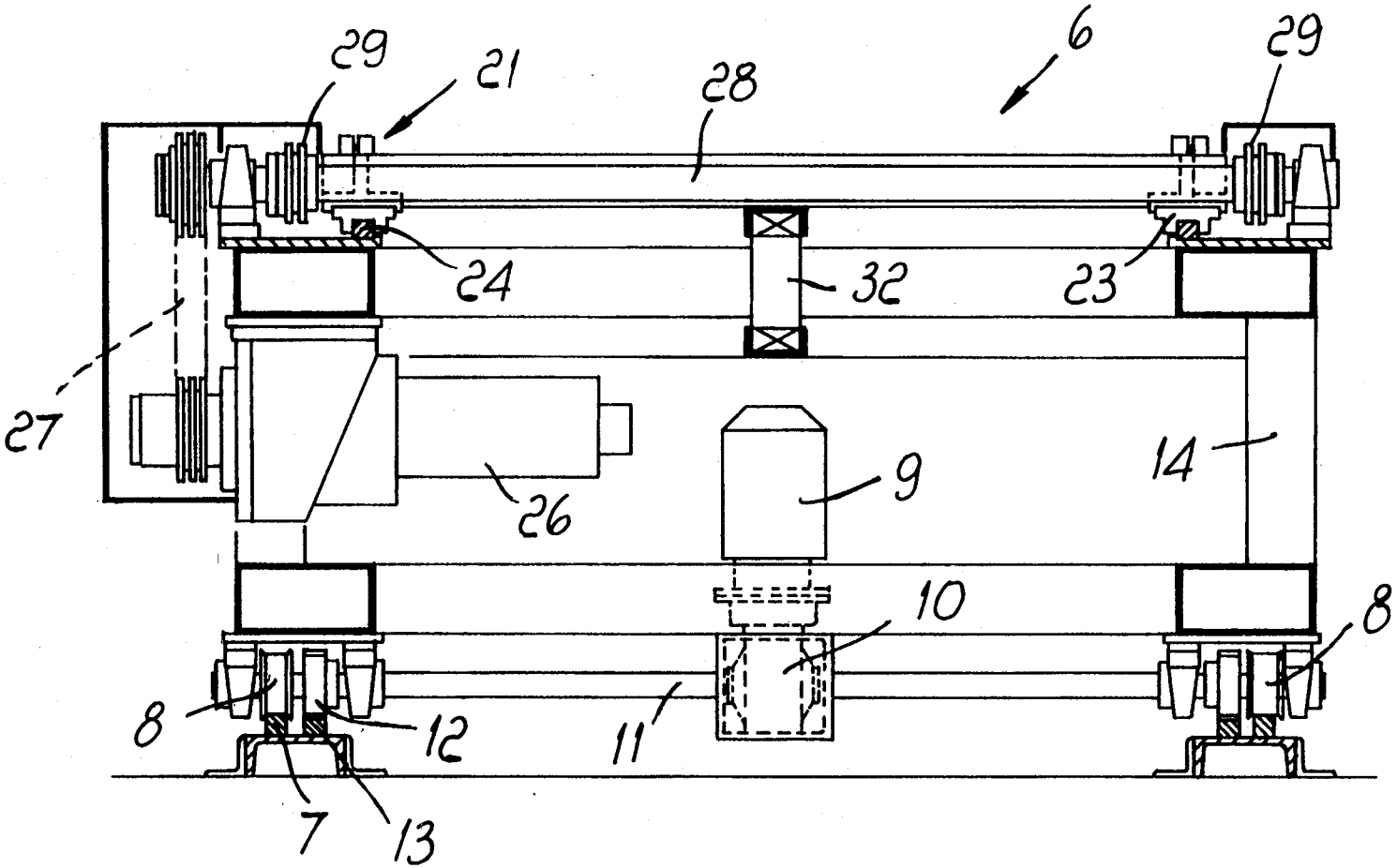
Figure 8:
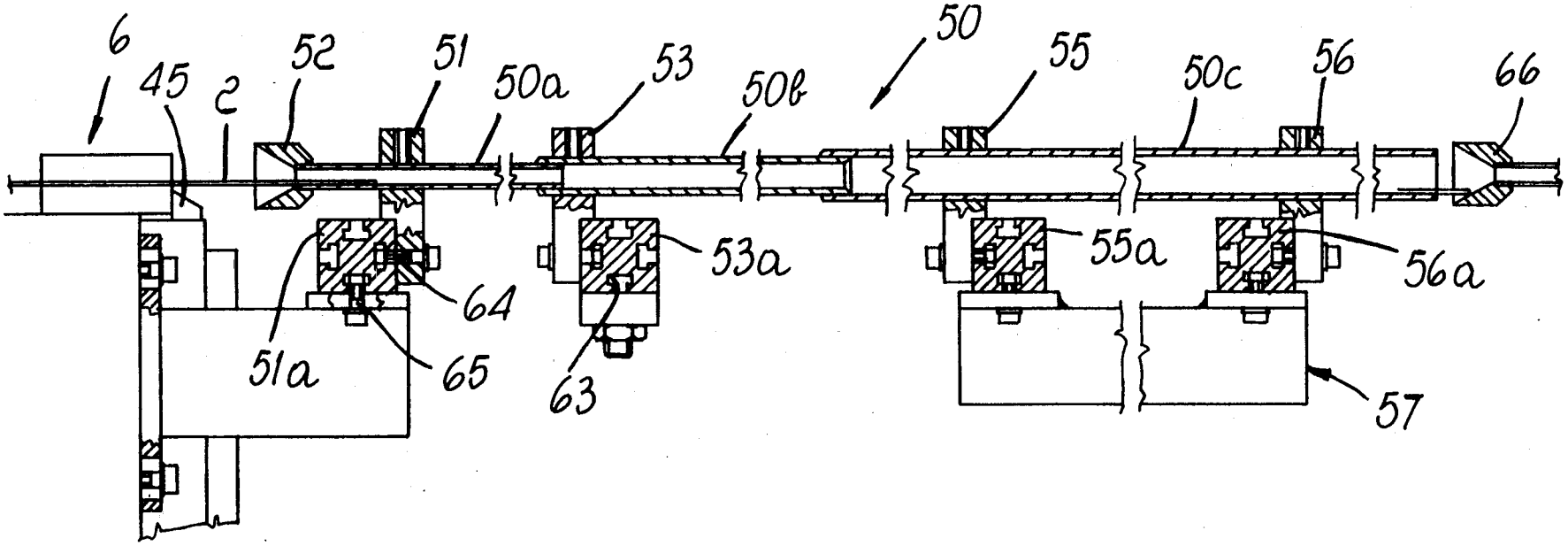
FIG. 8 is a longitudinal vertical sectional view of the device, taken at said tubular means.

The grip elements 21 move rigidly with the cross-member 22, which is actuated in alternating directions along the carriage 6 by means of the chains 25 driven by the numeric-control motor 26. In practice, when the pneumatic clamps 30 are at the rear end of the pulling device 20 (see the broken-line illustration 22*a* of the cross-member 22 in FIG. 4), they grip the related wires 2 to pull them to the front end of said device (solid-line illustration of the cross-member 22 in the same figure): the advancement of the cross-member and thus the pulling performed by the clamps occur intermittently, according to the cycle of the welding machine 3, i.e.

according to the distance of the transverse wires in the electrically welded net. Once the clamps 30 reach the front end of the pulling device, they open and, while the vise-like elements 43 momentarily secure the wires 2, the cross-member 22 performs a rapid return stroke to 22*a* so that the clamps can perform a subsequent pulling of said wires.

While they are being pulled on the carriage 6, the longitudinal wires 2 pass through the related straightening elements 15 and 16 and are therefore appropriately straightened on the horizontal and vertical planes.

When they leave the carriage 6, the wires 2 are inserted in the respective telescopic tubes 50, which guide them to the welding machine 3. The wires 2 thus fed are then gripped by the clamps of the welding machine, which replace the grip elements 21 of the pulling device 20 of the carriage 6 in order to pull said wires after they have been cut.

The welding machine welds, at uniform distances, the transverse wires to the longitudinal wires 2 to produce the metallic net. After the welding machine has welded the first transverse wire to the longitudinal wires 2, the cutting means 44 of the carriage 6 cut said wires 2. Advancement of the cut portion of the wires 2 is ensured, as mentioned above, by the welding machine 3 itself.

After the cutting of the longitudinal wires 2, the tensions induced by the straightening operation are released completely. This ensures the perfect planarity and uniformity of the metallic net manufactured by subsequently welding the transverse wires to the longitudinal wires cut to size.

It should be particularly stressed that the described device allows to continuously manufacture metallic nets of the required length. The length of the metallic net is in fact determined in practice by the distance between the cutting plane defined by the blade 45 of the carriage 6 and the welding plane defined by the welding machine 3.

This length can be changed by moving the pulling carriage 6, as mentioned above. The telescopic tubes 50 automatically adapt to this distance, since the elements 50*a*, 50*b* and 50*c* retract into one another so as to vary the overall length of said tubes.

Figures 1B, 2B:
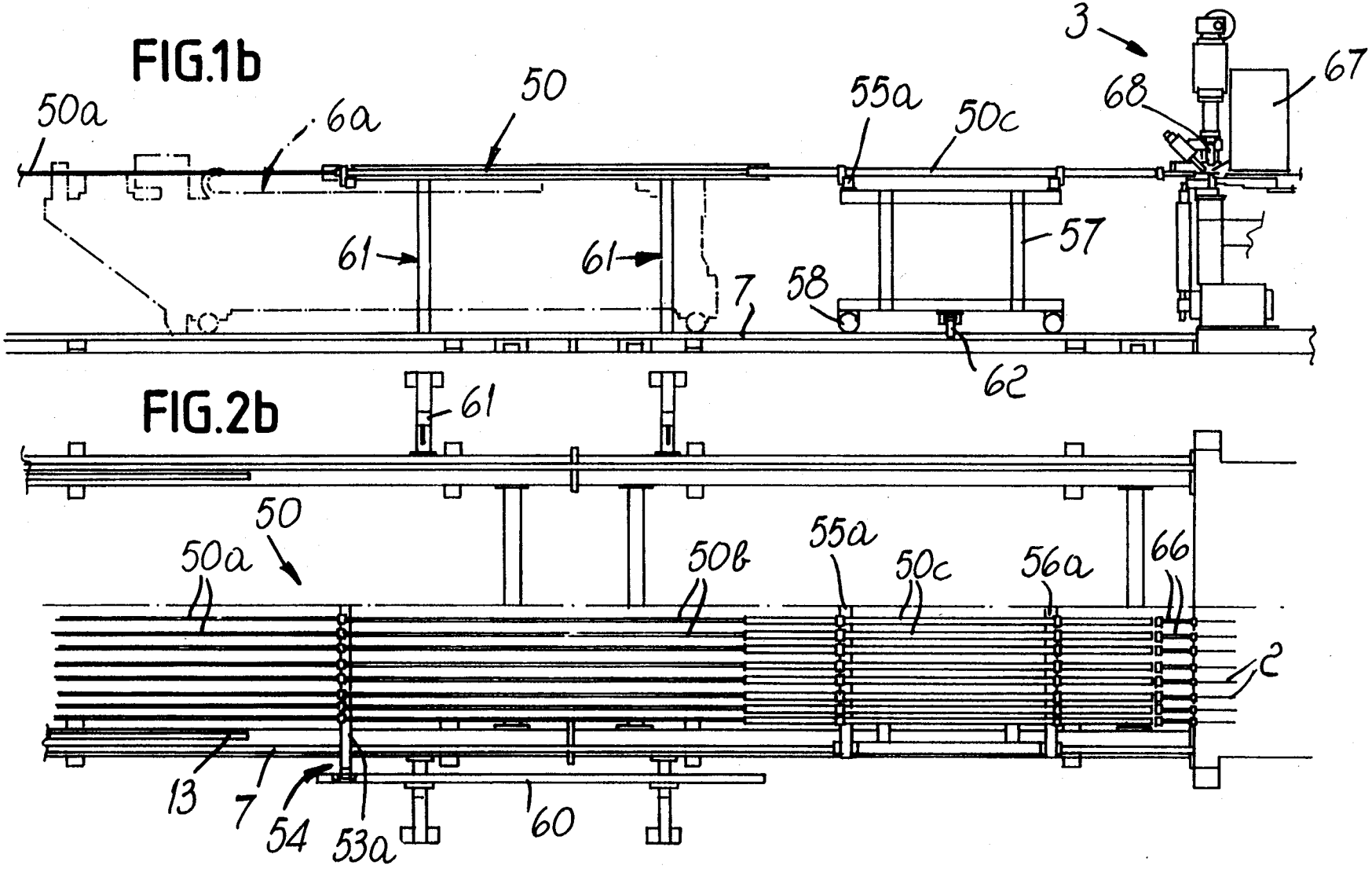
Figure 3:
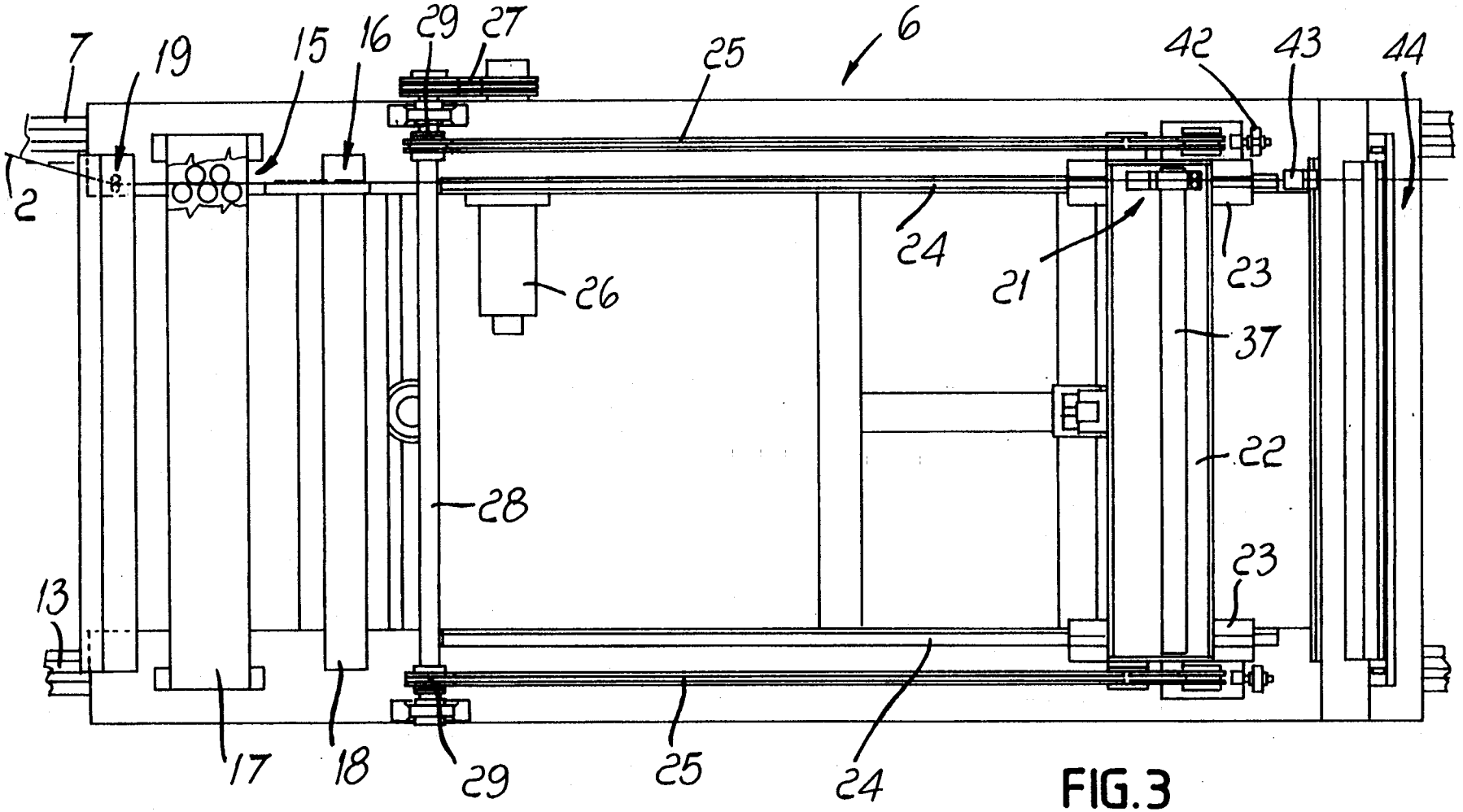
FIG. 3 is a plan view of said pulling carriage of the feeder device.

In practice, the length of the net can be changed within the range comprised between a maximum length, defined by the complete extension of the telescopic tubes 50, and a minimum length, defined by the complete retraction of the telescopic elements 50*a* and 50*b* in the element 50*c*, i.e. substantially by the length of said element 50*c*. FIG. 1*b* illustrates, by means of the broken line 6*a*, the position assumed by the pulling carriage in the minimum-length configuration.

It should be noted that the carriage 54 for the intermediate support of the telescopic tubes 50 automatically follows the movements imparted to the tubular elements 50*b*.

To sum up, the feeder device according to the present invention allows to continuously manufacture electrically welded metallic nets of any length, within a preset range, ensuring the uniformity of the manufactured nets. The continuous operation of the device furthermore avoids downtimes, ensuring high productivity.

In the practical execution of the invention, the materials employed, as well as the shape and dimensions, may be any according to the requirements.

I claim:

1. In a machine for continuously manufacturing electronically welded flat reinforcement nets of the type having a plurality of straight longitudinal metallic wires and a plurality of linear transverse metallic wires welded to said straight longitudinal metallic wires at uniform distances, an electric welding machine (3) of the type having a drop-down magazine (67) for transverse wires, an inlet (66) for longitudinal wires (2), and welding elements (68) for welding together said transverse wires and said longitudinal wires (2), and a device for feeding said longitudinal wires (2) to said inlets (66) of said electric welding machine (3) comprising;

supporting means (5) supporting coils (4) of wire (2) to be fed;

rails (7) at least partially extending between said supporting means (5) and said electric welding machine (3);

a motorized carriage (6) movable back and forth along said rails (7) towards and away from said electric welding machine (3);

a plurality of wire straighteners (15, 16) mounted on said motorized carriage (6);

means (20) for pulling said wire (2) including a beam (22) mounted transversely on said carriage (6), a plurality of grip elements (21) connected to said beam (22), and means (25–29) for longitudinally moving said beam (22) and said grip elements (21) with respect to said carriage (6);

vise-like elements (43) for preventing backward movement of said wires (2) connected to said carriage (6) adjacent said grip elements (21);

cutting means (44–48) for cutting fed wire (2) connected to said carriage (6) adjacent said vise-like elements (43);

telescopic wire guiding means (50–58) located between said carriage (6) and said inlet (66), and;

means (51, 53–58, 60) for supporting said telescopic wire guiding means (50–58).

2. A device according to claim 1, further comprising racks (13) located adjacent said rails (7), and wherein said motorized carriage comprises a drive unit (9) mounted on said carriage (6), transmission means (10) driven by said drive unit (9), a transverse shaft (11) connected to said carriage (6) and rotated by said transmission means (10), and at least two pinions (12) connected to said transverse shaft (11) and meshing with said rack (13).

3. A device according to claim 1, wherein said carriage is constituted by a frame (14), said frame (14) having cross-members (17, 18), said wire straighteners being (15, 16) adjustably mounted on said cross members (17, 18).

4. A device according to claim 1, further comprising a guiding inlet (19), and wherein at least two of said wire straighteners (15, 16) are arranged in series, said guiding inlet (19) being arranged between said coils of wire (4) to be fed and one of said at least two wire straighteners (15, 16).

5. A device according to claim 1, wherein said means (25–29) for longitudinally moving said beam (22) and said grip elements (21) with respect to said carriage (6, 9, 10–12) comprise a numeric control motor (26) connected to said carriage (6), a shaft (28) rotatably connected to said carriage (6) and having keyed thereto a plurality of drive pulleys (29), a transmission (27) for transmitting motion from said numeric control motor

(26) to said drive pulleys (29), and a kinematic transmission (25) for transmitting motion from said drive pulleys (29) to said beam (22).

6. A device according to claim 1, wherein said plurality of grip elements (21) comprise pneumatic clamps (30), each of said pneumatic clamps (30) comprising a guide (37) fixed to said cross member (22), a bracket (35) connected to said guide (37), pivots (34) connected to said bracket (35), a pair of arms (33) rotatably connected to said pivots (34), and a single-action cylinder (31) rigidly coupled to said bracket (35) and acting on said arms (33).

7. A device according to claim 1, further comprising carriage locking means (49) connected to said carriage (6) for locking engagement with said rails (7).

8. A device according to claim 1, wherein said means (51, 53–58) for supporting said telescopic wire guiding means (50–58) comprise;

a supporting element (51) connected to said carriage (6);

movable supporting means (55–58) spaced from said supporting element (51), and;

intermediate supporting means (53–54, 60) located between said supporting element (51) and said movable supporting means (55–58).

9. A device according to claim 8, wherein said telescopic wire guiding means (50–58) located between said carriage (6) and said inlet (66) comprise;

a first tubular element (50*a*) supported by said supporting element (51) and having a wire inlet (52);

a second tubular element (50*b*) supported by said intermediate supporting means (55, 56) and having a diameter greater than said first tubular element (50*a*), a portion of said first tubular element (50a) being inserted into said second tubular element (50*b*);

a third tubular element (50*c*) supported by said movable supporting means (55–58) and having a diameter greater than said second tubular element (50*b*), a portion of said second tubular element (50*b*) being inserted into said third tubular element (50*c*).

10. A device according to claim 9, wherein said movable supporting means (55–58) comprise;

a bench (57);

a pair of supporting elements (55, 56) rigidly connected to said bench (57), and;

wheels (58) connected to said bench (57) and movable on said rails (7), and wherein said intermediate supporting means (53, 54) comprise;

a pair of outer rails (60) arranged outside said rails (7), and;

an intermediate support element (53) coupled to an intermediate carriage (54), said intermediate carriage (54) having a cross-member (53*a*), said cross-member (53*a*) being slideably mounted on said outer rails (60).

11. In a machine for continuously manufacturing electronically welded flat reinforcement nets of the type having a plurality of straight longitudinal metallic wires and a plurality of linear transverse metallic wires welded to said straight longitudinal metallic wires at uniform distances, an electric welding machine (3) of the type having a drop-down magazine (67) for transverse wires, an inlet (66) for longitudinal wires (2), and welding elements (68) for welding together said transverse wires and said longitudinal wires (2), and a device for feeding said longitudinal wires (2) to said inlets (66) of said electric welding machine (3) comprising;

supporting means (5) supporting coils (4) of wire (2) to be fed;

rails (7) at least partially extending between said supporting means (5) and said electric welding machine (3);

a motorized carriage (6) movable back and forth along said rails (7) towards and away from said electric welding machine (3);

a plurality of wire straighteners (15, 16) mounted on said motorized carriage (6), at least two of said wire straighteners (15, 16) being arranged in series;

means (20) for pulling said wire (2) including a beam (22) mounted transversely on said carriage (6), a plurality of fluid-activated clamps (30) connected to said beam (22), and numerically controlled means (25–29) for longitudinally moving said beam (22) and said fluid-activated clamps (30) with respect to said carriage (6);

vise-like elements (43) for preventing backward movement of said wires (2) connected to said carriage (6) adjacent said fluid-activated clamps (30);

cutting means (44–48) for cutting fed wire (2) connected to said carriage (6) adjacent said vise-like elements (43);

telescopic wire guiding means (50–58) located between said carriage (6) and said inlet (66), and;

means (51, 53–58, 60) for supporting said telescopic wire guiding means (50–58).

12. A device according to claim 11, further comprising racks (13) located adjacent said rails (7), and wherein said motorized carriage comprises a drive unit (9) mounted on said carriage (6), transmission means (10) driven by said drive unit (9), a transverse shaft (11) connected to said carriage (6) and rotated by said transmission means (10), and at least two pinions (12) connected to said transverse shaft (11) and meshing with said rack (13).

13. A device according to claim 11, wherein said carriage is constituted by a frame (14), said frame (14) having cross-members (17, 18), said wire straighteners being (15, 16) adjustably mounted on said cross members (17, 18).

14. A device according to claim 11, further comprising a guiding inlet (19), said guiding inlet (19) being arranged between said coils of wire (4) to be fed and one of said at least two wire straighteners (15, 16).

15. A device according to claim 11, wherein said numerically controlled means (25–29) for longitudinally moving said beam (22) and said grip elements (21) with respect to said carriage (6, 9, 10–12.) comprise a numeric control motor (26) connected to said carriage (6), a shaft (28) rotatably connected to said carriage (6) and having keyed thereto a plurality of drive pulleys (29), a transmission (27) for transmitting motion from said numeric control motor (26) to said drive pulleys (29), and a kinematic transmission (25) for transmitting motion from said drive pulleys (29) to said beam (22).

16. A device according to claim 1, wherein said plurality of fluid-activated clamps (30) comprise a plurality of pneumatic clamps (30), and wherein said pneumatic clamps (30) each comprise a guide (37) fixed to said cross member (22), a bracket (35) connected to said guide (37), pivots (34) connected to said bracket (35), a pair of arms (33) rotatably connected to said pivots (34), and a single-action cylinder (31) rigidly coupled to said bracket (35) and acting on said arms (33).

17. A device according to claim 1, further comprising carriage locking means (49) connected to said carriage (6) for locking engagement with said rails (7).

18. A device according to claim 1, wherein said means (51, 53–58) for supporting said telescopic wire guiding means (50–58) comprise;

a supporting element (51) connected to said carriage (6);

movable supporting means (55–58) spaced from said supporting element (51), and;

intermediate supporting means (53–54, 60) located between said supporting element (51) and said movable supporting means (55–58).

19. A device according to claim 18, wherein said telescopic wire guiding means (50–58) located between said carriage (6) and said inlet (66) comprise;

a first tubular element (50*a*) supported by said supporting element (51) and having a wire inlet (52);

a second tubular element (50*b*) supported by said intermediate supporting means (55, 56) and having a diameter greater than said first tubular element (50*a*), a portion of said first tubular element (50*a*) being inserted into said second tubular element (50*b*);

a third tubular element (50*c*) supported by said movable supporting means (55–58) and having a diameter greater than said second tubular element (50*b*), a portion of said second tubular element (50*b*) being inserted into said third tubular element (50*c*).

20. A device according to claim 19, wherein said movable supporting means (55–58) comprise;

a bench (57);

a pair of supporting elements (55, 56) rigidly connected to said bench (57), and;

wheels (58) connected to said bench (57) and movable on said rails (7), and wherein said intermediate supporting means (53, 54) comprise;

a pair of outer rails (60) arranged outside said rails (7), and;

an intermediate support element (53) coupled to an intermediate carriage (54), said intermediate carriage (54) having a cross-member (53*a*), said cross-member (53*a*) being slideably mounted on said outer rails (60).

* * * * *